US011596268B2

(12) United States Patent
Watson

(10) Patent No.: US 11,596,268 B2
(45) Date of Patent: Mar. 7, 2023

(54) MULTI-COMPARTMENT WALK-IN BATHTUB

(71) Applicant: James Robert Watson, Frenchtown, NJ (US)

(72) Inventor: James Robert Watson, Frenchtown, NJ (US)

( * ) Notice: Subject to any disclaimer, the term of this patent is extended or adjusted under 35 U.S.C. 154(b) by 0 days.

(21) Appl. No.: 17/648,586

(22) Filed: Jan. 21, 2022

(65) Prior Publication Data

US 2022/0279983 A1 Sep. 8, 2022

Related U.S. Application Data

(60) Provisional application No. 63/158,148, filed on Mar. 8, 2021.

(51) Int. Cl.
*A47K 3/00* (2006.01)

(52) U.S. Cl.
CPC ..... *A47K 3/006* (2013.01)

(58) Field of Classification Search
CPC ..... A47K 3/006
USPC ..... 4/555–557, 639, 564.1, 565.1
See application file for complete search history.

(56) References Cited

U.S. PATENT DOCUMENTS 3,604,018 A * 9/1971 Moran ..... A47K 3/006 4/556
6,256,807 B1 * 7/2001 Steadman ..... A61G 7/1059 4/564.1

FOREIGN PATENT DOCUMENTS

EP 1428467 A1 * 6/2004 ..... A47K 3/006
GB 2406787 A * 4/2005 ..... A47K 3/006

* cited by examiner

*Primary Examiner* — Tuan N Nguyen
(74) *Attorney, Agent, or Firm* — Squire Patent Consulting & IP Law LLC; Brendan E. Squire

(57) ABSTRACT

A multi-compartment walk-in bathtub is disclosed that allows for a first compartment of the walk-in bathtub to be filled with a quantity of water while a second compartment of the walk-in bathtub allows the user to enter the bathtub. A first movable gate contains a volume of water in the first compartment while the second compartment is in an unfilled condition. A second movable gate is operable to open and close an entry sidewall of the bathtub, allowing the user to enter the second compartment. The second movable gate is then moved to a closed position. When the second movable gate is in the closed condition, the first movable gate may be moved to an open condition to release the volume of water and fill the walk-in bathtub to a filled condition. A seat may be provided that is selectively elevated and lowered by drive mechanism.

8 Claims, 4 Drawing Sheets

MULTI-COMPARTMENT WALK-IN BATHTUB

CROSS-REFERENCE TO RELATED APPLICATION

This application claims the benefit of priority of U.S. provisional application No. 63/158,148 filed Mar. 8, 2021, the contents of which are herein incorporated by reference.

BACKGROUND OF THE INVENTION

The present invention relates to bathtubs, and more particularly to walk-in bathtubs.

Walk-in bathtubs feature a door or an access panel in a sidewall of the tub to allow the user to step into the bathtub without the need to step over the sidewall of the tub. Unlike a conventional bathtub, in walk-in bathtubs, the user must wait until the bathtub fills while the user either sits or stands within the closed bathtub enclosure. This delay can range from a simple inconvenience to ambulatory users and can present significant difficulties for caregivers for non-ambulatory or a non-compliant patient As can be seen, there is a need for a multi-compartment walk-in bathtub that solves these and other problems.

SUMMARY OF THE INVENTION

In one aspect of the present invention, a multi-compartment walk-in tub is disclosed. The multi-compartment walk-walk in tub includes a first compartment having at least one sidewall. The first compartment is dimensioned to contain a volume of water. A second compartment is connected with the first compartment and the at least one sidewall. A first movable gate is operable between a closed position and an open position. In the closed position, the volume of water is retained in the first compartment and in the open position, the volume of water is released from the first compartment to the second compartment. A second movable gate is operable in the sidewall of the second compartment between an open position and a closed position. In the open position an access way is defined in the sidewall of the second compartment. In the open position, the access way is closed, and the second compartment is configured to contain the volume of water when released from the first compartment.

In some embodiments, a seat is mounted within the first compartment. A drive mechanism is configured to selectively elevate and lower the seat. The drive mechanism includes a motor a drive screw operable by the motor; and a carrier interconnecting the seat with the drive screw.

In some embodiments, a first track separates the first compartment from the second compartment. The first movable gate is carried within the first track.

In some embodiments, a second track is defined in the access way. The second movable gate is carried in the second track.

In some embodiments, a seal is provided within each of the first track and the second track. The seal engages with each respective first gate and second gate to contain the volume of water.

In some embodiments, a first lock is operable to retain the first movable gate in the closed position. A second lock is also operable to retain the second movable gate in the closed position.

In some embodiments, at least one drain is operable to release the volume of water from one or more of the first compartment and the second compartment.

In other embodiments, a shower door is movable to contain water released from a shower head within the second compartment and/or the first compartment.

These and other features, aspects and advantages of the present invention will become better understood with reference to the following drawings, description and claims.

DETAILED DESCRIPTION

Figure 1:
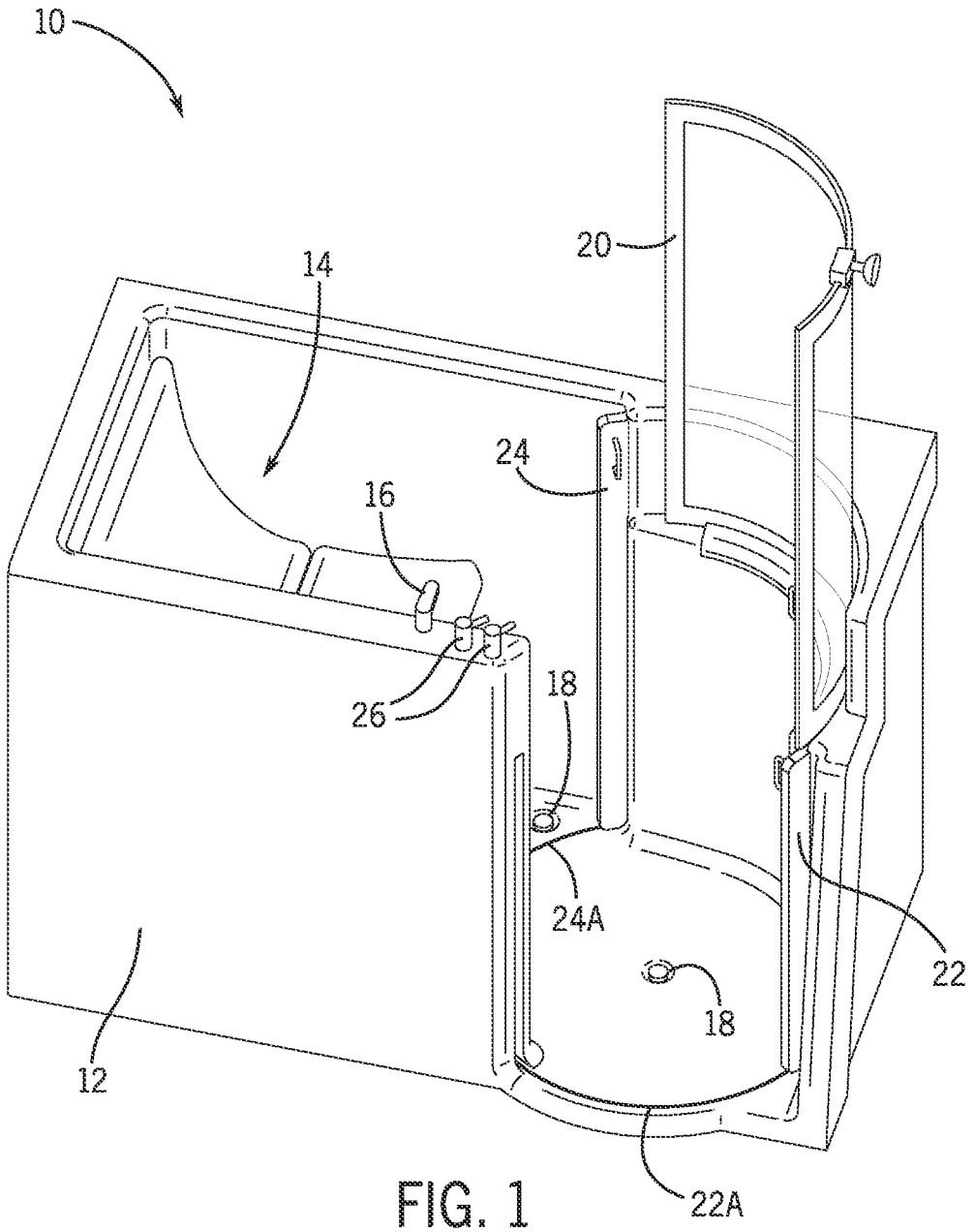
FIG. 1 is a front perspective view of the a multi-compartment walk-in bathtub shown in an open condition.
Figure 2:
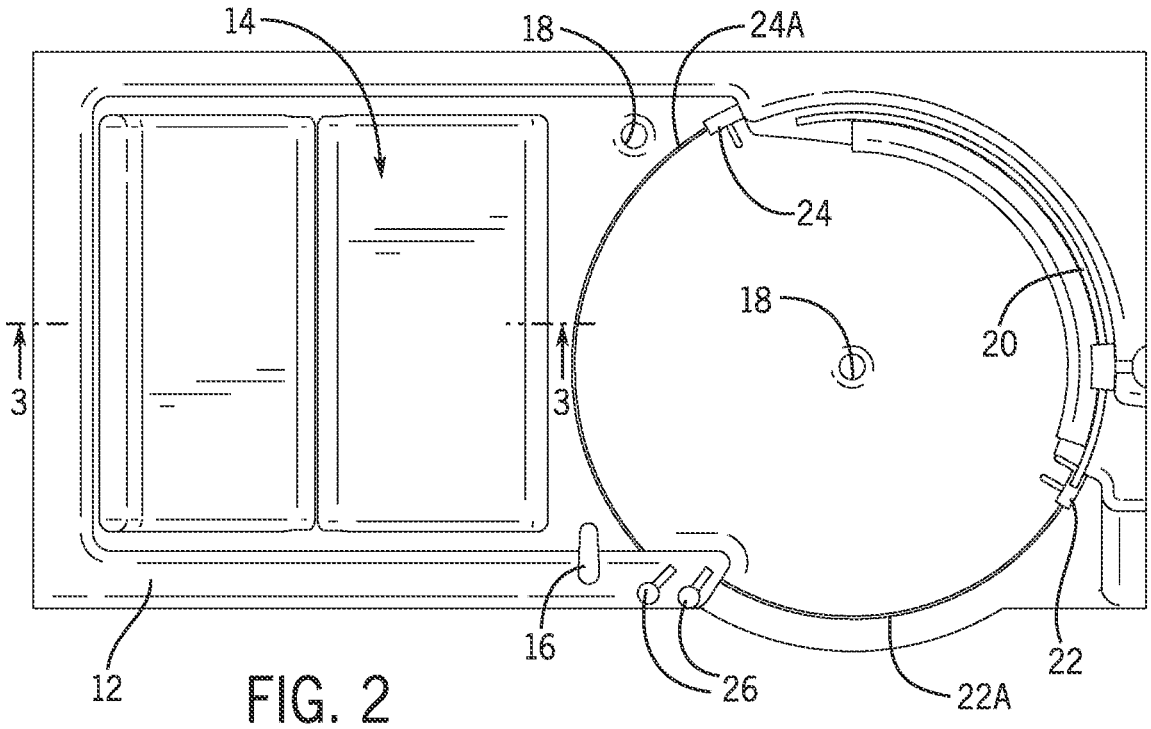
FIG. 2 is a top plan view of the a multi-compartment walk-in bathtub.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide a multi-compartment walk-in bathtub that allows for a first compartment of the walk-in bathtub to be filled with a quantity of water while a second compartment of the walk-in bathtub allows the user to enter the bathtub. A first movable gate contains a volume of water in the first compartment while the second compartment is in an unfilled condition, allowing the user to enter the second compartment. A second movable gate is operable to open and close an entry sidewall of the bathtub, allowing the user to enter the second compartment. The second movable gate is then moved to a closed position. When the second movable gate is in the closed condition, the first movable gate may be moved to an open condition to release the volume of water and fill the multi-compartment walk-in bathtub to a filled condition.

As seen in reference to the drawings of FIGS. 1-7, the multi-compartment walk-in bathtub 10 includes an outer shell 12 having at least one sidewall. A first compartment may include a seat 14 for the user to utilize when taking a bath. The multi-compartment walk-in bathtub 10 includes a waterspout 16, or spigot, and one or more control valves (not shown) that are operable to control a flow and a temperature of a volume of water 30 to fill the walk-in bathtub 10. One or more drains 18 are provided to drain the volume of water 30 from the walk-in bathtub 10.

The first movable gate 24 is provided to separate the first compartment and the second compartment of the walk-in tub 10 during a filling of the first compartment. With the first movable gate 24 positioned in the closed position, the first compartment may be filled to a desired volume of water 30. In the non-limiting embodiment shown, the first movable gate 24 has an arcuate shape and is carried within an arcuate sidewall of the second compartment. The first movable gate 24 may be carried in a track 24*a* separating the first compartment from the second compartment. A seal (not shown) is provided about a lower peripheral and a side edge of the first movable gate 24 to contain the volume of water in the first compartment.

In the non-limiting embodiment shown, the second compartment may be substantially circular in shape. The second compartment includes a second movable gate 22 defined in the at least one sidewall. The second movable gate 22 is carried and operable in a second gate track 22A between an open condition and a closed condition. In the open condition, the user may step through an access way through the at least one sidewall. In the closed condition, the second gate 22 closes the access way to contain the volume of water 30 within the second compartment.

A lock 26 is provided for securing each of the first movable gate 24 and the second movable gate 22 to secure the first movable gate 24 and the second movable gate 22 in the closed, water containing position.

Figure 3:
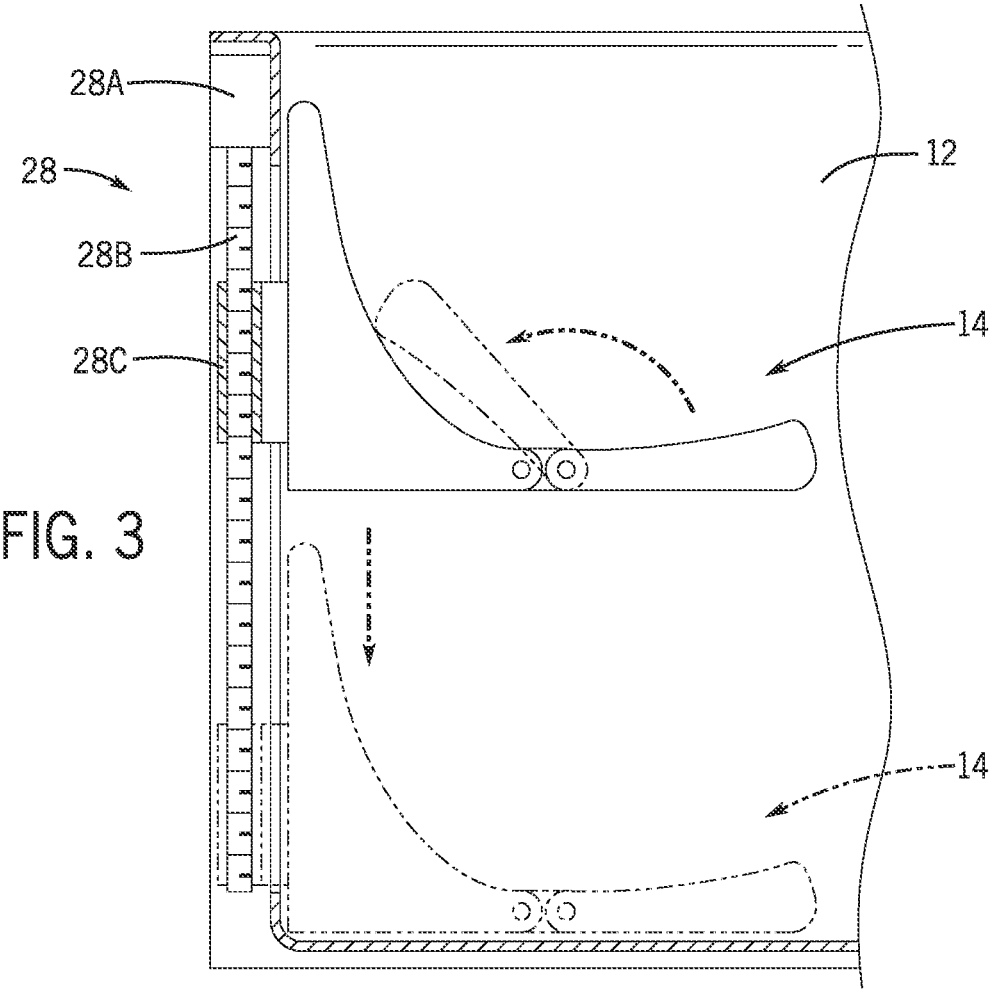
FIG. 3 is a cross-sectional view taken on line 3-3 of FIG. 2.
Figure 5:
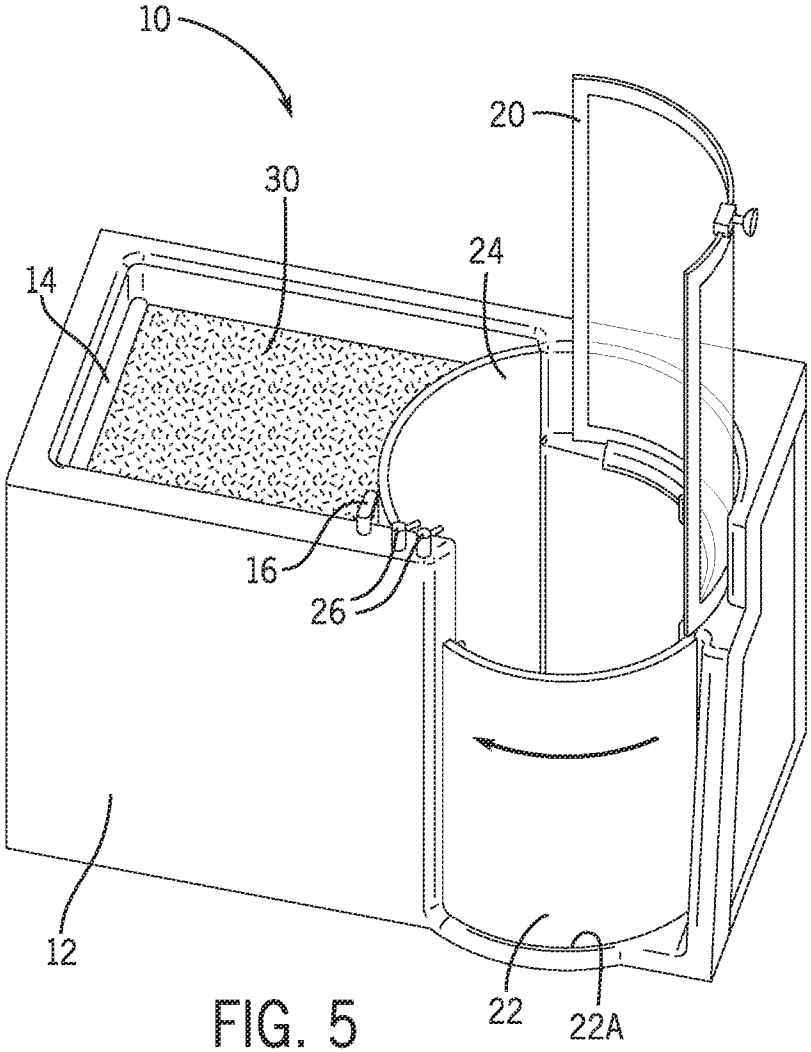
FIG. 5 is a front perspective view, similar to FIG. 1, showing the a multi-compartment walk-in bathtub in a second stage of use.
Figure 4:
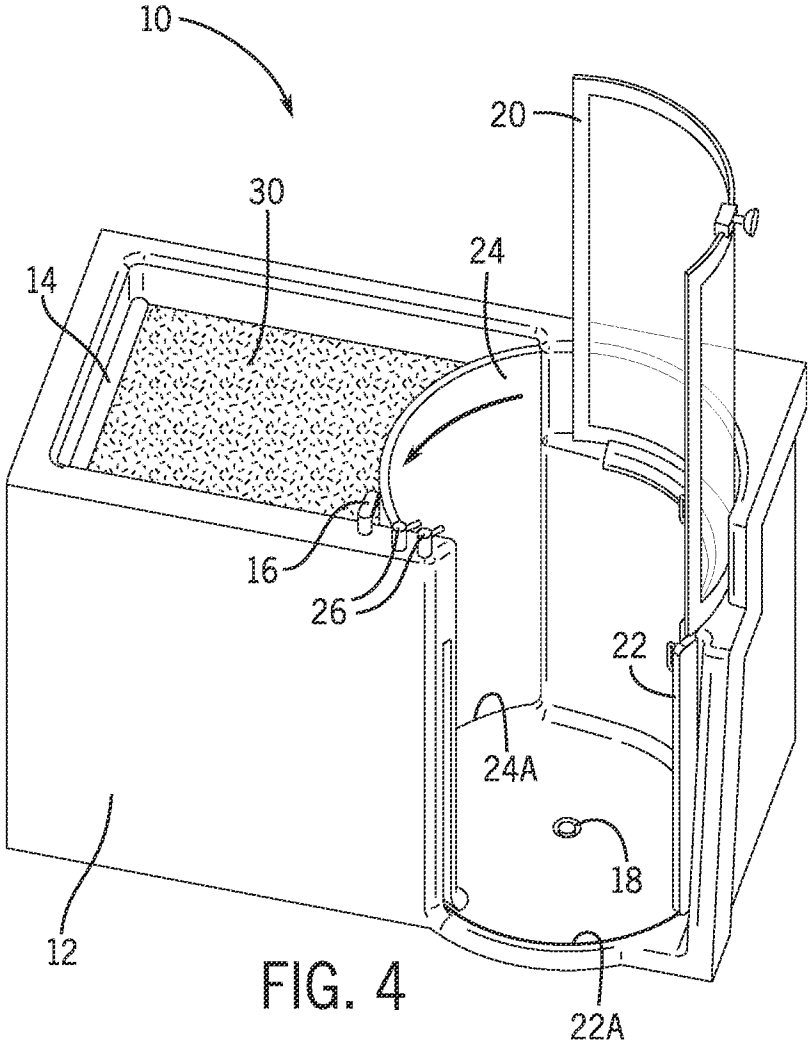
FIG. 4 is a front perspective view, similar to FIG. 1, showing the a multi-compartment walk-in bathtub in a first stage of use.
Figure 7:
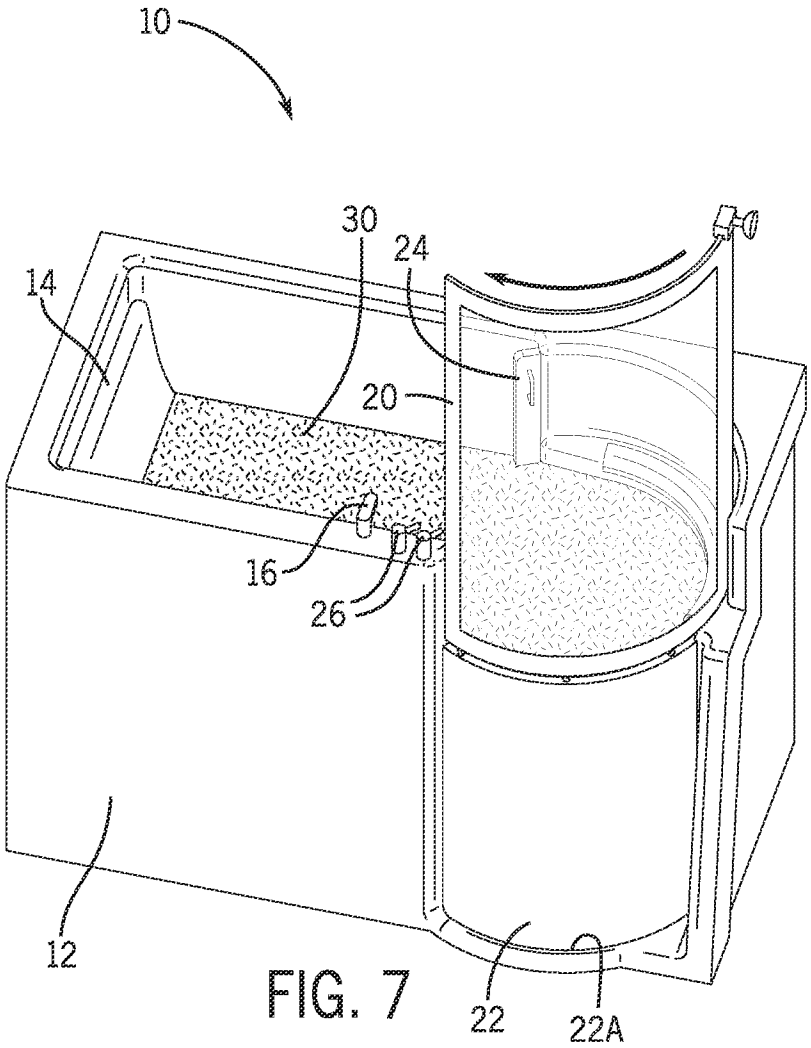
FIG. 7 is a front perspective view, similar to FIG. 1, showing the a multi-compartment walk-in bathtub in a fourth stage of use.
Figure 6:
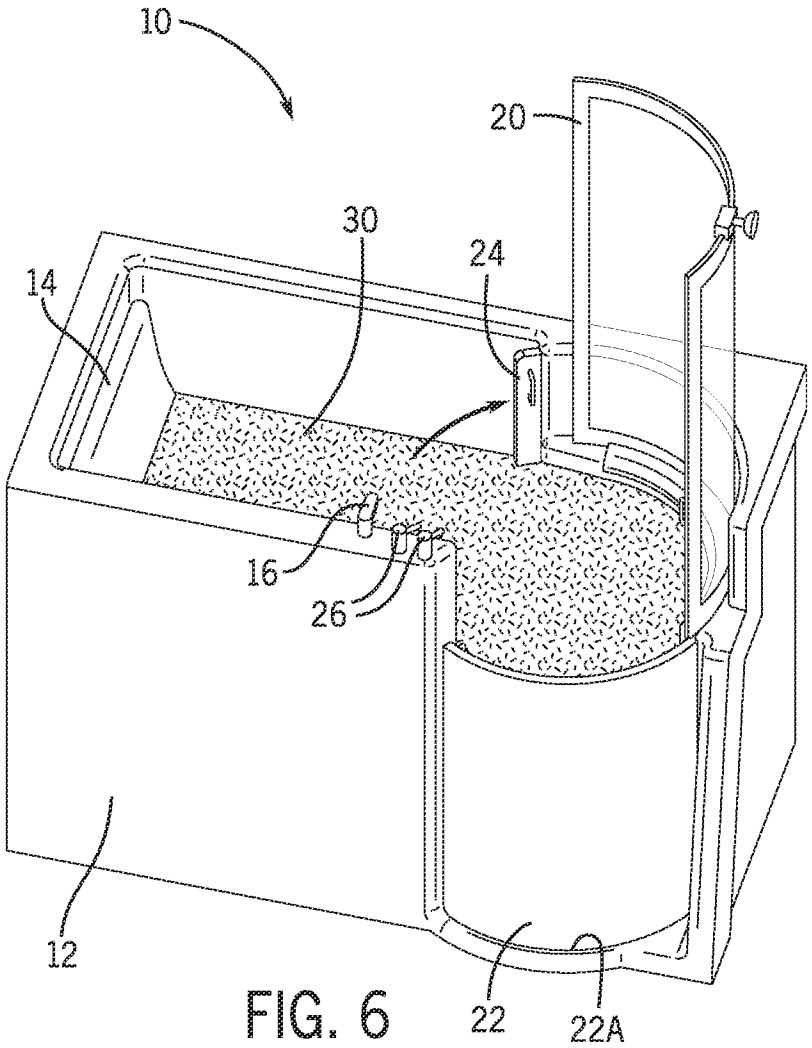
FIG. 6 is a front perspective view, similar to FIG. 1, showing the a multi-compartment walk-in bathtub in a third stage of use.

As seen in reference to FIG. 3, a drive mechanism 28 is provided to selectively elevate and lower the seat within the first compartment. The drive mechanism 28 may include a motor 28A operable to turn a drive screw 26B. A back rest of the seat 14 includes a carrier 28C for cooperative engagement with the drive screw 26B such that the seat is raised or lowered by a rotation of the drive screw 26B. The seat 14 may include a tilting base portion that prevents splashing or displacement of the volume of water 30 carried in the first compartment when the seat 14 is raised or lowered within the volume of water 30. In other embodiments, the drive mechanism may include a scissors type lift, a cantilevered beam, or a hoist arrangement as may be needed for different user conditions.

The second compartment may be configured as a shower in which a shower door 20 is movable to contain water released from a shower head within the second compartment and/or the first compartment.

In operation, the first gate 24 is secured in the closed condition and is secured by the corresponding lock 26. The first compartment may then be filled with a desired volume and temperature of water 30. When the user is ready to take their bath, the user enters through the access way and secures the second gate 22 in the closed position with its associated lock 26. Once the second gate 22 is secured, the user may then open the first gate 24, releasing the volume of water 30 contained within the first compartment to quickly fill the second compartment. The user may then complete their bath. The user may elevate the seat 14 to a desired elevation and then selectively lower the seat 14 to a desired elevation.

As will be appreciated, the first compartment will preferably have a significantly larger containment volume than the second compartment, such that the volume of water 30 contained within the first compartment provides a suitable volume of water 30 for bathing in the walk-in bathtub 10 when the volume of water 30 has equalized between the first compartment and the second compartment.

When the user has completed their bath, they may then open the one or more drains 18. Once the volume of water 30 has drained from the first compartment and the second compartment, the user may actuate the lock 26 securing the second gate 22 and depart the walk-in tub 10 through the access way.

It should be understood, of course, that the foregoing relates to exemplary embodiments of the invention and that modifications may be made without departing from the spirit and scope of the invention as set forth in the following claims.

What is claimed is:

1. A multi-compartment walk-in tub, comprising:

a first compartment having at least one sidewall, the first compartment dimensioned to contain a volume of water;

a second compartment connected with the first compartment and the at least one sidewall;

a first movable gate operable between a closed position and an open position, wherein in the closed position, the volume of water is retained in the first compartment, and in the open position, volume of water is released from the first compartment to the second compartment;

a second movable gate operable in a sidewall of the second compartment between an open position and a closed position, wherein in the open position an access way is defined in the sidewall of the second compartment, and in the closed position, the access way is closed, and the second compartment is configured to contain the volume of water when released from the first compartment, and the first movable gate and the second movable gate independently operable between their respective open position and the closed position;

a first track separating the first compartment from the second compartment, wherein the first movable gate is carried within the first track; and a second track defined in the access way, wherein the second movable gate is carried in the second track.

2. The multi-compartment walk-in tub of claim 1, further comprising:

a seat mounted within the first compartment.

3. The multi-compartment walk-in tub of claim 2, further comprising:

a drive mechanism configured to selectively elevate and lower the seat.

4. The multi-compartment walk-in tub of claim 3, the drive mechanism further comprising:

a motor, a drive screw operable by the motor; and a carrier interconnecting the seat with the drive screw.

5. The multi-compartment walk-in tub of claim 1, further comprising:

a seal within each of the first track and the second track, the seal engaging with each respective first gate and second gate to contain the volume of water.

6. The multi-compartment walk-in tub of claim 1, further comprising:

a first lock operable to retain the first movable gate in the closed position; and a second lock operable to retain the second movable gate in the closed position.

7. The multi-compartment walk-in tub of claim 1, further comprising:

at least one drain operable to release the volume of water from one or more of the first compartment and the second compartment.

8. The multi-compartment walk-in tub of claim 1, further comprising:

a shower door movable to contain water released from a shower head within the second compartment and/or the first compartment.

* * * * *